United States Patent [19]

Donath

[11] 3,945,809

[45] Mar. 23, 1976

[54] METHOD AND APPARATUS FOR REMOVING COARSE UNENTRAINED CHAR PARTICLES FROM THE SECOND STAGE OF A TWO-STAGE COAL GASIFIER

[75] Inventor: Ernest E. Donath, Christiansted, St. Croix, V.I.

[73] Assignee: The United States of America as represented by the United States Energy Research and Development Administration, Washington, D.C.

[22] Filed: July 8, 1975

[21] Appl. No.: 594,165

[52] U.S. Cl. ..... 48/73; 48/87; 48/202; 201/38; 201/42; 209/11; 209/138; 252/373

[51] Int. Cl.[2] ..... C10K 3/06

[58] Field of Search ..... 48/202, 73, 87; 209/138, 209/139 R, 11; 201/38, 42; 252/373

[56] References Cited

UNITED STATES PATENTS

| | | | |
|---|---|---|---|
| 2,741,549 | 4/1956 | Russell | 209/138 |
| 2,796,391 | 6/1957 | Brown | 201/42 |
| 3,782,913 | 1/1974 | Donath | 48/202 |

*Primary Examiner*—S. Leon Bashore
*Assistant Examiner*—George C. Yeung
*Attorney, Agent, or Firm*—Dean E. Carlson

[57] ABSTRACT

A method and apparatus for removing oversized, unentrained char particles from a two-stage coal gasification process so as to prevent clogging or plugging of the communicating passage between the two gasification stages. In the first stage of the process, recycled process char passes upwardly while reacting with steam and oxygen to yield a first stage synthesis gas containing hydrogen and oxides of carbon. In the second stage, the synthesis gas passes upwardly with coal and steam which react to yield partially gasified char entrained in a second stage product gas containing methane, hydrogen, and oxides of carbon. Agglomerated char particles, which result from caking coal particles in the second stage and are too heavy to be entrained in the second stage product gas, are removed through an outlet in the bottom of the second stage, the particles being separated from smaller char particles by a counter-current of steam injected into the outlet.

4 Claims, 1 Drawing Figure

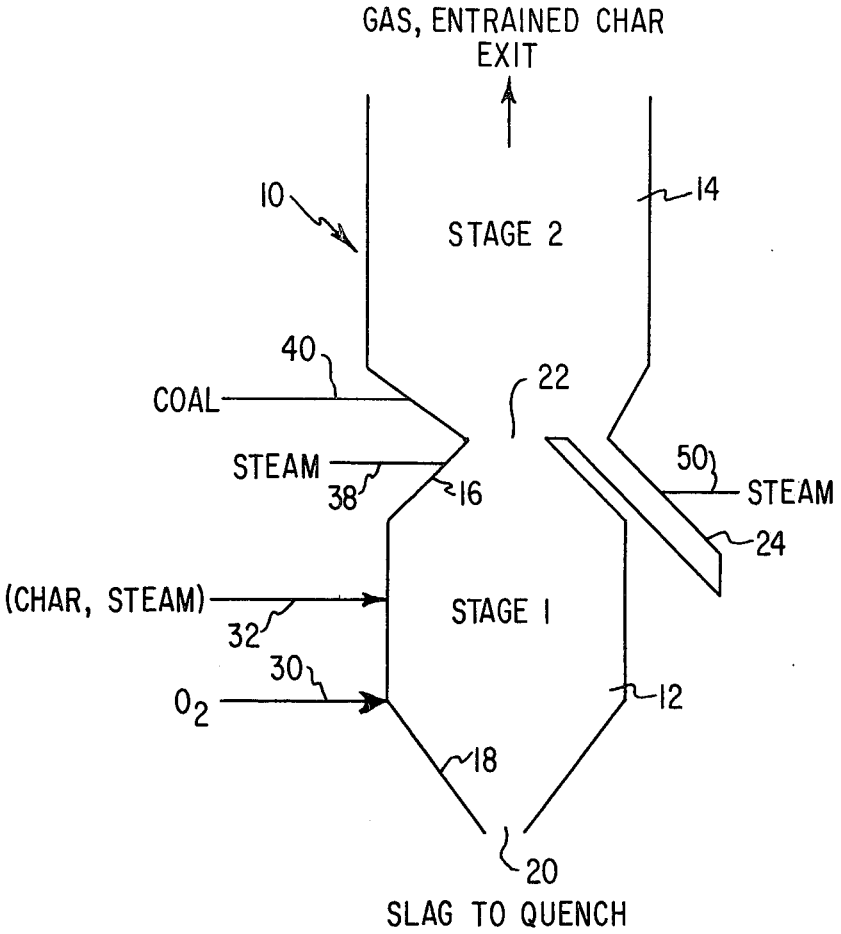
GAS, ENTRAINED CHAR
EXIT
10
14
STAGE 2
40
22
COAL
STEAM
38
16
50
STEAM
24
(CHAR, STEAM)
32
STAGE 1
30
$O_2$
12
18
20
SLAG TO QUENCH

METHOD AND APPARATUS FOR REMOVING COARSE UNENTRAINED CHAR PARTICLES FROM THE SECOND STAGE OF A TWO-STAGE COAL GASIFIER

BACKGROUND OF THE INVENTION

1. Field of the Invention

The invention relates to a process for production of methane rich fuel gas by two-stage gasification of either caking or non-caking coals, and, more particularly, to a method and apparatus for the removal of oversized char particles that would not be carried out by the gas stream up-flow.

2. Description of the Prior Art

A method of producing methane fuel gas using a two-stage gasification process is described in my earlier U.S. Pat. No. 3,782,913. In this process steam and particulate coal are reacted in the second stage with synthesis gas from the first stage, which contains hydrogen and oxides of carbon at temperatures in excess of 1600°F and pressures in excess of 50 atmospheres, to produce a product gas containing hydrogen, methane, carbon oxides, and entrained char. The product gas and entrained char are withdrawn and separated, the product gas being thereafter treated to remove carbon oxides and other diluents, and ultimately methanated to produce methane-rich fuel gas. The char is recycled to the first gasification stages for reaction with steam and oxygen at temperatures in excess of 2500°F and pressures in excess of 50 atmospheres to produce a synthesis gas containing hydrogen and oxides of carbon for reaction in the second gasification stage.

The efficiency at which the coal particles and the char product particles are entrained in the up-flow gas in the second stage is a key factor affecting the overall efficiency of the process. One problem that has been encountered in this regard is that particles of some kinds of coal, generally called caking coals, tend to agglomerate as they become char product particles. Moveover, some proportion of the char product particles so formed become too large to be entrained by the product gases of the second stage. Consequently, these oversize char particles will accumulate and will tend to plug the passage for first stage synthesis gas. This problem is of considerable importance since a majority of the coals found in the Eastern United States are of a caking nature.

SUMMARY OF THE INVENTION

In accordance with the invention, a method and apparatus is provided for withdrawing or removing oversized char particles from the second stage of a two-stage coal gasification process.

As described hereinabove, in the first stage of the process in question, recycled process char reacts with steam and oxygen as it passes upwardly therewith to produce a synthesis gas containing hydrogen and carbon oxides. In the second stage, the first stage synthesis gas reacts with coal and steam passing upwardly therewith to produce a second stage char which is entrained in the second stage product gas containing methane, hydrogen and carbon oxides. Between the first and second stages, the synthesis gas passes through a restricted mixing stage, coal and steam being injected upwardly into the mixing stage toward the second stage to provide mixing and rapid reaction of the coal and steam with the synthesis gas. According to the present invention, an arrangement is provided at the bottom of the second stage for removing the oversize char particles which tend to accumulate in this area and which can block the passage between the stages. This oversized char removal arrangement preferably comprises an outlet passage having an inlet which opens into the bottom of the second stage and means for injecting flushing gas, preferably steam, upwardly through the passage toward the second stage. The injection of flushing gas or steam into the outlet passage ensures that only oversized char particles which are capable of traveling against the counter flow produced by the steam are removed and hence that smaller particles, capable of being entrained in the second stage gas, are not removed. The velocity of the flushing gas or steam is between 0.4 and 4 feet per second based on the open cross-section of the outlet passage. Further, the steam serves to cool the oversized char particles as they leave the gasifier. The steam, or part thereof, can be generated by injecting liquid water onto the hot char in the outlet passage to achieve better cooling of the coarse, withdrawn char. The outlet passage can be connected to a lock hopper for depressurizing or discharging of the particles that are removed. These coarse char particles can also be recycled for use in the first stage of the process, either directly or after grinding.

It will be appreciated that the oversized char removal method and apparatus of the invention increases the efficiency of the process by maintaining a maximum amount of char in the second stage gas while preventing accumulation of large char particles that can block or plug the passage between the stages. Moreover, with the problems caused by so-called caking coals substantially reduced or eliminated, the applicability of the bi-gas process is extended to all areas of the country.

Other features and advantages of the invention will be set forth in, or apparent from the detailed description of preferred embodiments found hereinbelow.

BRIEF DESCRIPTION OF THE DRAWINGS

The single FIGURE in accompanying drawings is a highly diagrammatic section view of a two-stage coal gasification apparatus incorporating the invention.

DESCRIPTION OF THE PREFERRED EMBODIMENTS

Referring to the single FIGURE in the drawings, a two-stage gasification vessel, indicated generally at 10, includes a lower portion 12, and an upper portion 14, the first stage of a two-stage gasification process taking place in the lower portion 12 and the second stage taking place in the upper portion 14. The lower portion 12 of vessel 10 has an upper truncated conical portion 16 and a lower truncated conical portion 18. The downwardly converging conical walls of the lower truncated portion 18 converge to form a slag removal area or port 20. The upwardly converging conical walls of the upper portion 16 of the first stage 12 converge to form a throat 22 between the upper portion 14 and the lower portion 12.

Recycle process char mixed with steam at high pressure is injected into the lower portion 12 of vessel 10 through a conduit indicated at 32 and reacted therein with oxygen introduced into the lower portion 12 of vessel 10 through a further suitable conduit 30. The char, oxygen and steam are introduced and injected into the lower portion 12 at high velocity and in such fashion that rapid mixing and reaction of the various reactants occurs. The reaction in the lower portion 12 of vessel 10 is the first stage of the gasification process and produces a synthesis gas containing hydrogen and oxides of carbon, this synthesis gas passing upwardly through the throat 22 into the upper portion 14 of vessel 10.

First stage synthesis gas which passes upwardly through the upper conical portion 16 of the vessel lower portion 12 through the throat 22 is rapidly mixed with coal and steam as described hereinbelow. Throat 22 should have a cross sectional area which is preferably less than 20% of the cross sectional area of the smaller of the lower and upper portions 12 and 14 of vessel 10 so as to restrict gravitation of coal downwardly through the throat 22. At a location near the most narrow cross sectional area of the throat 22, superheated steam is injected upwardly through a plurality of ports or nozzles which are indicated at 38 and surround throat 22. It is preferred that at least ten nozzles 38 be employed and that these nozzles be directed radially upward toward upper portion 14 of vessel 10 to restrict the entry of coal into the lower portion 12 of vessel 10 from upper portion 14. Coal is introduced into throat 22 through ports 40 at locations above the steam ports 38 to provide rapid mixing with the synthesis gas and injected steam passing upwardly through throat 22. The mixture of coal, steam, and synthesis gas passes upwardly through the upper portion 14 while reacting to yield a second stage product including partially gasified char entrained with a second stage product gas comprising methane, hydrogen, and oxides of carbon.

As discussed above, oversized char particles, which result as caking coal particles react with synthesis gas and steam to form agglomerating char and the second state product gas, can be of such a size and weight that they are not entrained in the second stage product gas with the other char particles. These oversized particles would normally gravitate towards throat 22 between vessel upper portion 14 and vessel lower portion 12, where they would accumulate and cause possible plugging or blocking of throat 22. In accordance with the invention, an outlet passage or trough 24 is provided which opens into the upper portion 14 of vessel 10 in the area of throat 22. A counter-current or counter-flow of steam is provided in passage 24 by steam which is injected into passage 24 from a port or nozzle 50 and directed upwardly along passage 24. The velocity of the upwardly directed steam injected through nozzle 50 is controlled so as to prevent small char particles which are capable of being entrained in the second stage gas flow from entering passage 24. However, oversized char particles which are too large to be entrained in the second stage product gas can exit from portion 14 of vessel 10 along passage 24, through the steam counter-current injected by nozzle 50. It should be noted that the steam entering through nozzle 50 also serves to cool the large char particles in addition to preventing exiting of the smaller ones.

Oversized char particles can be directed from the passage 24 to a lock hopper (not shown) or the like used in depressurizing or discharging the particles. The particles can also be recycled to stage one, either directly or after grinding.

While the invention has been described in detail with particular reference to the preferred embodiments thereof, it will be understood by those skilled in the art that variations and modifications can be effected in the exemplary embodiments within the spirit and scope of the invention.

I claim:

1. A method for removing oversized char particles which are produced in a two-stage coal gasification process by reacting a first stage synthesis gas with coal and steam in a mixing zone in the second stage, and which are too large to be entrained in an upwardly directed second stage gas stream, said method comprising:

withdrawing said oversized char particles through an exit passageway which opens into the bottom of said mixing zone, and directing a counter-flow of steam in a direction which is opposite to that in which the particles are removed so as to prevent removal of char particles of a size capable of being entrained in the second stage gas stream.

2. In a two-stage coal gasification apparatus for producing methane-rich fuel gas comprising a gasification vessel including an upper portion, a lower portion and a mixing throat connecting the upper and lower portions; means for passing a synthesis gas from the lower portion of the vessel upwardly into said mixing throat, and said mixing throat including means for injecting coal and steam thereinto for mixing with the synthesis gas to produce partially gasified char which is entrained in a second stage product gas that passes upwardly through the upper portion of the vessel; the improvement comprising means for removing oversized char particles which are formed in said mixing throat and which are too large to be entrained in said second stage product gas, said means comprising means defining a downwardly extending exit passageway which opens into the bottom of said mixing throat and through which said oversized char particles can be removed and means for injecting a counter-flow of fluid in said passageway for preventing the removal of particles which are of a size capable of being entrained within said second stage product gas.

3. An apparatus as claimed in claim 2 wherein said fluid injecting means comprises means for injecting steam into said exit passageway.

4. A process for the two stage gasification of coal comprising:

passing recycled char upwardly through a first zone and reacting said char therein with superheated steam and oxygen to yield a first stage synthesis gas comprising hydrogen and oxides of carbon, passing the first stage synthesis gas from the first zone through a mixing zone having a cross sectional area substantially less than the cross sectional area of the first zone, injecting coal and superheated steam into said mixing zone and mixing said coal and superheated steam with the first stage synthesis gas passing therethrough, passing the mixture of steam, coal and first stage synthesis gas from the mixing zone into a second gasification zone, passing the mixture of coal, steam and first stage synthesis gas upwardly through the second zone while reacting the mixture to yield a second zone product comprising agglomerated char, and char entrained in a second zone product gas comprising methane, hydrogen and oxides of carbon, withdrawing the second zone product entrained char and second zone product gas together;

separately withdrawing the second zone product agglomerated char through an exit passageway which opens into the bottom of said mixing zone against a counter-current of steam, controlling the velocity and direction of flow of said counter-current of steam to prevent the exit of non-agglomerated char particles and to cool the said agglomerated char as it leaves the second stage through said exit passage, and recycling the separated agglomerated char to the first gasification zone.

* * * * *